United States Patent [19]

Stoody

[11] Patent Number: 4,595,127

[45] Date of Patent: Jun. 17, 1986

[54] SELF-CONTAINED FLUID PUMP AEROSOL DISPENSER

[76] Inventor: William R. Stoody, 8659 Summerdale Rd., San Diego, Calif. 92126

[21] Appl. No.: 612,131

[22] Filed: May 21, 1984

[51] Int. Cl.[4] ..... B67D 5/52; B67D 5/60; B67D 1/08; B05B 15/02

[52] U.S. Cl. ..... 222/135; 222/136; 222/145; 222/148; 222/531; 222/548; 222/635; 222/402.18; 239/113; 239/308; 239/340; 239/587; 239/579

[58] Field of Search ..... 239/112, 113, 308, 337, 239/340, 587, 579, 457; 222/129, 132, 635, 548, 148, 145, 135, 136, 531, 542, 188, 402.18; 137/588, 893

[56] References Cited

U.S. PATENT DOCUMENTS

| | | | |
|---|---|---|---|
| 3,297,209 | 1/1967 | Pungitore | 222/144.5 |
| 3,326,469 | 6/1967 | Abplanalp et al. | 239/308 |
| 3,469,744 | 9/1969 | Corsette | 222/188 X |
| 3,615,042 | 10/1971 | Marand | 222/635 X |
| 3,675,824 | 7/1972 | Hein | 239/308 X |
| 3,704,811 | 12/1972 | Harden, Jr. | 222/635 X |
| 4,161,288 | 7/1979 | McKinney | 239/579 X |
| 4,441,632 | 4/1984 | Stoody | 239/308 X |

*Primary Examiner*—Joseph J. Rolla
*Assistant Examiner*—Gregory L. Huson

[57] ABSTRACT

A barrier type product container wherein product is contained at atmospheric pressure and separate from a pressurizing gas. And, mounted thereon, for example, a valve actuator that preferably includes an ejector pump type nozzle element that is valvingly positionable to facilitate ventilating inflow of ambient air into the container and dispensation of product. The nozzle element is also positionable to inhibit ventilation of the container and effluence of product, and facilitate use of ambient air to purgingly dispel product residue from discharge passageways of the nozzle.

19 Claims, 24 Drawing Figures

SELF-CONTAINED FLUID PUMP AEROSOL DISPENSER

BACKGROUND OF THE INVENTION

The present invention pertains to an improved self-contained aerosol dispenser having a primary container wherein dispensible fluent product is contained at atmospheric pressure and kept isolated from pressure regenerating fluid, propellant, that is contained within a chamber, pressure vessel, that is closed by a valve means. More particularly the invention relates to an improved dispensatory means having a valvingly positionable ejector pump type nozzle element that is adapted to provide a controllable means for ventilatingly admitting ambient air into the product container and utilizing pressure fluid vapor discharge flow to effect product dispensation. And the nozzle is alternatively positionable to inhibit container venting and product effluence.

The invention further relates to the dispensatory means being capable of dispensing two fluent products either selectively or simultaneously. And the additional capability of the dispensatory means to be self-cleaning by purging use of ambient air or pressure fluid vapor.

The foregoing is accomplished by the dispensatory means being stationarily mounted on the product container and having a flexibly attached appendage that is adapted to provide a means for manipulating the pressure vessel valve and directing pressure vapor flow through the nozzle element. The stationary mounting has an additional advantage, in that, it allows the use of a simple aerosol type valve for pressure vapor discharge control.

PRIOR ART

Related prior art dispensers are described in the following U.S. Pat. Nos. Abplanalp et al. U.S. Pat. No. 3,326,469 dated June 1967; Corsette U.S. Pat. No. 3,469,744 dated September 1969; and Marand U.S. Pat. No. 3,615,042 dated October 1971.

These patents point out advantages of fluid pump aerosol type dispensers having a propellant vessel integrated with a primary container that holds dispensible fluent product. However, the prior art dispensers also share a deficiency of requiring depressible movement of the entire dispensatory means for manipulation of the propellant discharge valve.

Because of this single deficiency, the dispensers either allow unimpeded effluence of product, or they have a complex propellant discharge valve having a plurality of exiting passageways that are valved within the propellant valve to prevent uncontrolled product effluence and to enable venting of the product container.

In addition, the prior art dispensers having a means for controlling product effluence either require unreliable passage of a product flow line through the propellant vessel, or direct entry of a product flow line into a valved chamber of the propellant valve. In either case, they require a costly and unorthodox means for combining the propellant vessel and valve. And those dispensers that allow unimpeded product effluence also allow unimpeded outgassing of product and unimpeded air entry into the container. In many cases the air entry and outgassing tends to have a detrimental affect on the product when allowed to continue for several hours.

Despite the known advantages of the above prior art dispensers for keeping propellant separate from product prior to effluence, such dispensers are deficient, in that, they either fail to have a venting means that prevents leakage of product, or they require a complex propellant discharge valve and pressure vessel combination. In any event, they have not been practicle from an economic view point and therefore, they have not been widely accepted for general use.

SUMMARY OF THE INVENTION

There has been, therefore, a requirement for a simple, economical, self-contained fluid pump aerosol type dispenser capable of maintaining product isolation from pressure fluid prior to effluence. This requirement desirably must be obtainable by providing an aerosol dispenser having a self-cleaning, valvular, dispensatory means that is co-operatively coupled to a simple valving means mounted on a pressure vessel that is preferably suspended in the dispenser.

It is the object of the present invention to provide an improved aerosol dispenser wherein dispensible fluent product is stored at atmospheric pressure and kept isolated from pressurizing fluid until being dispensed.

Another object is that said dispenser includes a pressure fluid holding vessel having a valve means head structure for controlled release of pressure fluid vapor.

Another object is that said dispenser includes a stationary dispensatory means having a moveable valve manipulation button that is adapted to co-operatively couple with said valve means, and transmit pressure vapor through said dispensatory means.

It is another object to provide in said dispensatory means an ejector pump type nozzle element that utilizes pressure vapor flow to effect product dispensation.

A further object is to provide valvular engagement of said nozzle element within said dispensatory means, said nozzle element being rotatable to establish a secondary valve means for controlled ingression of ambient air into the dispenser, and to prevent uncontrolled egression of product.

A still further object is to provide an aerosol dispenser capable of separately storing a plurality of products, and having a valvular dispensatory means adapted to provide selective or concurrent dispensing of said product fluids.

These and other objects and advantages will be seen from the following specifications and claims in conjunction with the appended drawings.

DETAILED DESCRIPTION OF THE INVENTION

Figure 1:
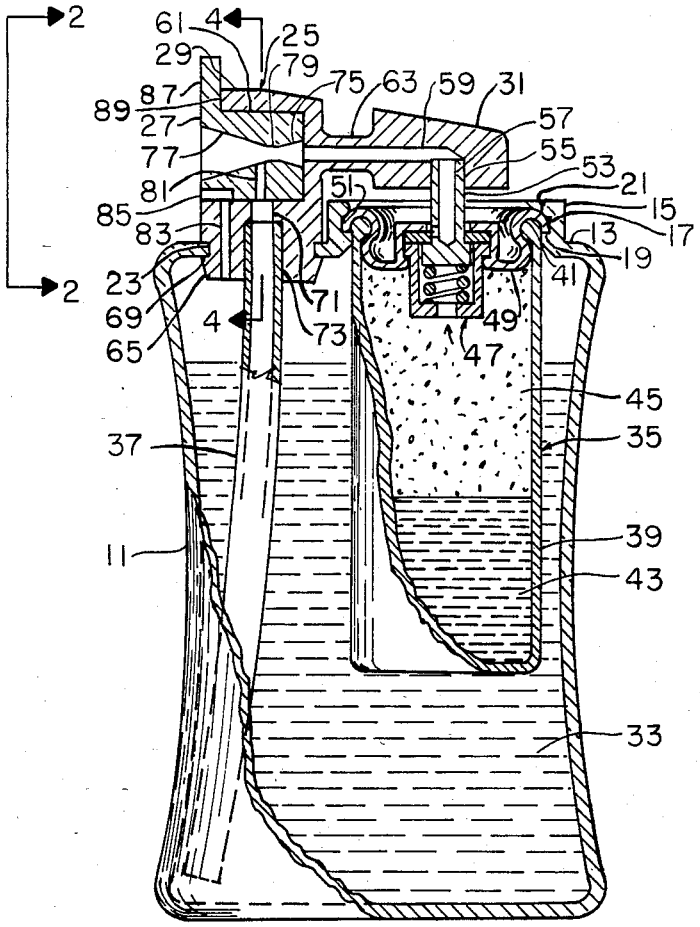
FIG.1 is a longitudinal cross section view of the preferred embodiment of the invention.

With reference to FIG. 1, there shown is an improved aerosol pump type dispenser having a primary container, referred to as bottle 11, that may be formed plastic or other suitable material. Bottle 11 has an integral top 13 that includes an outwardly projecting annular neck 15 having a large aperture 17 opening into the bottle interior. The lower end of aperture 17 is abruptly reduced in diameter to form an annular ledge 19, and located in the upper end of said aperture is an annular bead 21.

Top 13 also has radially spaced from neck 15, a second aperture 23 that opens into said bottle, and mounted thereon and projecting through aperture 23 is a valvular dispensatory means 25 that consists of a positionable ejector pump type nozzle element 27 and a stationary nozzle head 29 which is the primary structure portion of said dispensatory means. Said nozzle head is preferably molded of a somewhat resilient material, such as, plastic, and it has an integral valve manipulation button 31 appendage.

Contained within bottle 11 is, a dispensible fluid product 33, a pressure vessel 35 depending from aperture 17 and suspended in said bottle, and a tubular conduit 37 depending from nozzle head 29 and extending to the lower region of said bottle to provide fluid flow communicating means therefrom to nozzle element 27.

Pressure vessel 35 consists of, a substantially conventional one piece closed bottom cylindrical container 39 having an inwardly curled annular top opening 41, a pressure regenerating fluid 43 and pressure vapor 45 therefrom confined within container 39, and sealingly mounted on and closing opening 41 a common aerosol valve 47 that constitutes the head structure for said pressure vessel and provides a means for discharging said pressure vapor.

Valve 47 is of substantial prior art, therefore only the valve features pertinent to adaption of the valve are described herein. For mounting, said valve has a mounting cup 49 that has a raised outwardly and downwardly turned annular rim 51 secured in conventional sealing engagement with opening 41 providing closure of said vessel.

Vessel 35 is located and secured in bottle 11 by projecting said vessel downwardly through neck 15 aperture 17 until valve cup rim 51 is sealingly captured therein, between bead 21 and ledge 19. Neck 15 yieldingly allows snap-fit insertion of vessel 35 until the downwardly turned edge of rim 51 engages ledge 19, and bead 21 provides retention means for sealingly securing said vessel in place, and additional sealing is effected by having a friction-fit relationship between said reduced aperture diameter at ledge 19 and container 39.

Valve 47 also includes an outwardly extending depressable valve stem 53 that is snugly and cooperatively mated in a bore 55 provided therefore on the under side of valve manipulation button 31. Stem 53 contains an axial passageway 57 that is communicable with the interior of container 39 for discharge flow of vapor 45 from the container when said stem is in an operating depressed position. It is understood that stem 53 is resiliently disposed within said valve and axially reciprocatingly moveable, and normally upwardly biased to prevent communication between passageway 57 and the interior of container 39.

Passing horizontally through nozzle head 29 is a counter bored hole defining a passageway 59 that perpendicularly joins said valve manipulation button bore 55. Passageway 59 is adapted to direct flow of pressure vapor from valve stem passageway 57 through nozzle element 27 which is frictionally fitted in counter bore 61 of passageway 59.

Encircling passageway 59, at designation 63, is a relatively thin wall that flexibly joins manipulation button 31 to nozzle head 29, and enables said button to be reciprocatively moveable for operation of valve 47 while said nozzle head remains stationary.

For mounting, nozzle head 29 is provided with a terminus 65 that is tapered and projected through said second aperture 23. Formed about said terminus is an annular groove 69 that is sized for snap-fit insertion and sealing retention of nozzle head 29 in aperture 23.

Extending into nozzle head 29 from terminus 65 is a longitudinal passageway or hole 71 continuing from a larger diameter hole 73 within which an open end of conduit 37 is tightly fitted. Within nozzle head 29, hole 71 opens into the periphery of counter bore 61 within which nozzle element 27 is fitted. Thus, hole 71 and conduit 37 provide a continuous passage means for flow of fluent product from the lower region of bottle 11 to nozzle element 27.

Said nozzle element is basically a hollow cylindrical plug which may be of plastic or other suitable material. Centrally passing lengthwise through element 27 is a final passage designated 75, 77, 79 through which pressure vapor is directed to flow. Said passage is tapered inwardly at each end providing at one end thereof a pressure vapor entrance cone 75 continuing from passageway 59, and a pressure vapor exit cone 77 at the opposite end. A small diameter straight section orifice 79 is provided between said cones. There is also provided in element 27 at least one product suction tap 81 which opens into exit cone 77 perpendicular to the axis of said element. Tap 81 is situated to be aligned with said hole 71 opening into counter bore 61 for continuation of product flow from the lower region of bottle 11.

Tap 81 is also suitably located near orifice 79 so that when said manipulation button 31 is in a depressed position causing discharge flow of pressure vapor, the velocity of the departing vapor passing through orifice 79 will create a low suction pressure in said tap. The low pressure is capable of drawing product 33 through said tap and into the flow of departing vapor provided that tap 81 is aligned with hole 71 and bottle 11 is adequately vented.

To provide a means for said venting, nozzle head 29 terminus 65 is provided with a second hole or passage 83 which at one end opens into counter bore 61, and the other end of passage 83 opens into the upper interior region of bottle 11. To accommodate hole 83, nozzle element 27 has externally located along its periphery a notch 85. Said notch extends from the exit cone end of element 27 a sufficient distance to provide fluid flow communication with hole 83. Said notch is further situated and adapted to be aligned with hole 83 when tap 81 is aligned with passage 71. Notch 85 and hole 83 allow ventilating ingression of ambient air into bottle 11 when product is being drawn out.

Figure 2:
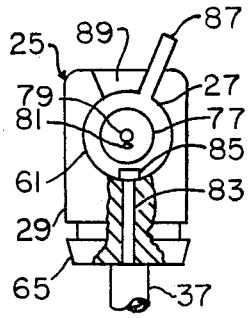
FIGS. 2, 3, 6 and 7 are views which are similar, taken substantially along line 2—2, of FIG. 1, to elaborate positioning of the valvular dispensatroy means for ambient air ingression.
Figure 3:
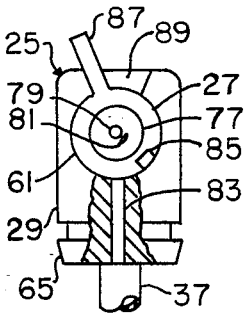
Figure 4:
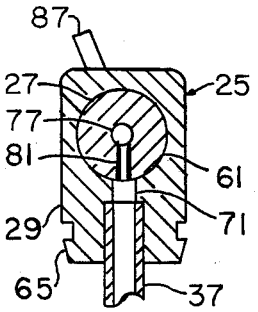
FIGS. 4 and 5 are views which are similar, taken substantially along line 4—4 of FIG. 1, to elaborate positioning of the valvular dispensatroy means for prevention of product egression.
Figure 5:
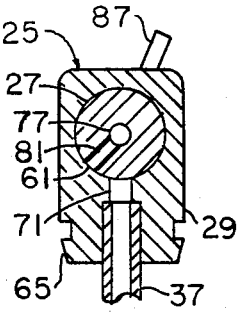

As seen by viewing FIGS. 2, 3, 4 and 5, said alignment of tap 81 and notch 85 with passages 71 and 83 is adapted to be valvingly controllable by partially turning nozzle element 27 in counter bore 61. FIGS. 2 and 4 show nozzle element 27 positioned for dispensation of product, whereas, FIGS. 3 and 5 show said nozzle element partially turned or rotated to a non-dispensing position. In said non-dispensing position, the outer diameter surface of element 27 sealingly covers openings of passages 71 and 83 into counter bore 61 blocking flow communication of tap 81 and notch 85 with said passages.

To facilitate said partial tarning of element 27, said element is provided with lever 87 that is integrally formed therewith and extends outwardly and upwardly from the exit cone end of said element. To provide limits for turning of nozzle 27, the mouth of bore 61 has provided thereat a recess 89 within which lever 87 is situated.

Thus, it can be realized and understood that said dispensatory means 25 is indeed valvular, and provides a means separate from the pressure vessel valve 47 for controlling egression of product and ingression of ambient air through either tap 81 or notch 85. This function is of particular importance, it provides a simple means for blocking communication between the interior and exterior of bottle 11 to prevent leakage of product and detrimental ingression of air when the the dispenser is not in use. And it does not require any additional parts.

Figure 6:
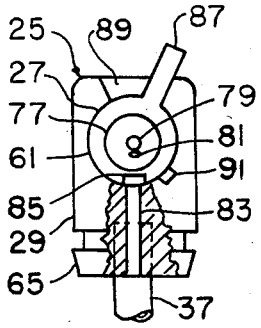
Figure 7:
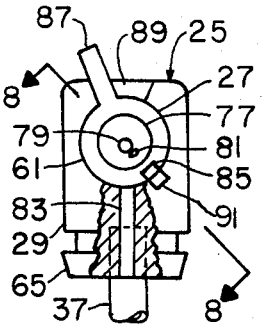
Figure 8:
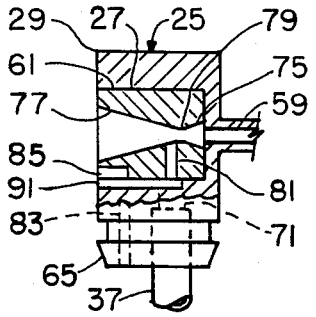
FIG. 8 is a fragmentary cross section view taken along line 8—8 of FIG. 7 to illustrate the self-cleaning provision of the dispenser, enabling purging use of ambient air.

Dispensatory means 25 as shown in FIGS. 6, 7 and 8 includes a means for self-cleaning by use of ambient air as a purging medium to clear product residue from tap 81. It should be realized that tap 81 is the only place that requires cleaning because it is the only place open to atmosphere where product residue could remain when said nozzle element is positioned for non-dispensing. Said self-cleaning means can be best seen in FIG. 8.

The means for self-cleaning is provided by a longitudinal notch 91 located in said nozzle head counter bore 61, said notch extends from the mouth of said counter bore a sufficient distance to enable air flow communication with tap 81 of element 27. And notch 91 is situated to be aligned with tap 81 only when element 27 is positioned for non-dispensing.

When element 27 is positioned for non-dispensing of product, as shown in FIG. 7, the alignment of notch 91 with tap 81 allows purging flow of ambient air through said tap for removing product residue therefrom. The surface fit of the outer diameter of element 27 with respect to counter bore 61 sealingly blocks passages 71 and 83, and thereby prevents communication between nozzle element 27 and bottle 11. However, with nozzle element 27 positioned to dispense product, as seen in FIG. 6, flow communication between notch 91 and tap 81 is sealingly prevented by the surface fit of element 27 in bore 61.

When nozzle element 27 is positioned to allow said self-cleaning, purging flow of air through tap 81 can be effected by operation of button 31 to cause pressure vapor flow through said orifice 79. Since pressure vapor flowing through said orifice creates a low pressure at tap 81, ambient air will be purgingly drawn inwardly through notch 91 and tap 81 and immediately be dispelled with discharged vapor.

The disclosed construction described in reference to FIGS. 1–8 represents the preferred embodiment of the invention. It is fully anticipated that variations of the features and parts can be made without departing from the spirit or scope of the invention. For example: it should be obvious that the valve stem 53 could be an integral part of button 31 as commonly provided for aerosol dispensers; clogs or detents could be provided in recess 89 for positional retention of lever 87; and notch 91 could instead be a hole opening into bore 61 through a side of the nozzle head.

Additional modifications will follow. And in describing these modifications, whenever practicle, features and parts that are like or similar to those previously described are designated with numbers that respectively have the same last two digits as those numbers used in the previous descriptions. Generally descriptions of features and parts previously described will not be repeated in any greater depth than necessary.

MODIFICATION

Figure 9:
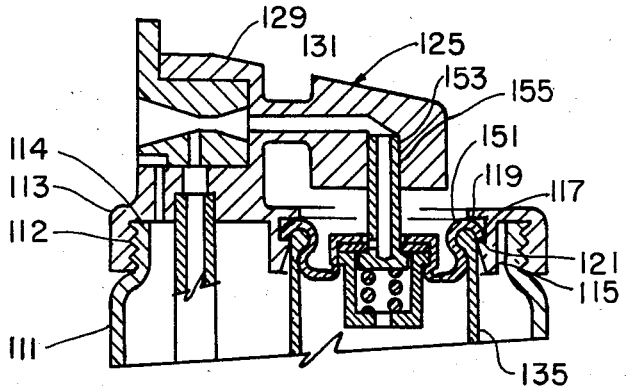
FIG. 9 is a fragmentary sectional view of an alternative embodiment for the present invention.

Fragmentarily shown in FIG. 9 is an alternative embodiment of the invention, having a product container, bottle 111, that is sealingly and detachably affixed to a closure top 113 which is an integral member of a nozzle head 129 which constitutes the primary structure of a valvular dispensatory means 125. And in this embodiment, a pressure vessel 135 is dependingly attached to the under side of said top 113, and suspended in bottle 111.

In providing for top 113 and nozzle head to be integral, substitute features for terminus 65 taper, annular groove 69 and aperture 23 previously described in reference to dispensatory means 25 are not required, and therefore they are not provided.

For said detachable affixing, said closure top 113 is provided with an internally threaded annular rim 112, and bottle 111 is correspondingly provided with a mating externally threaded annular open end 114. It is anticipated that in the event that a detachment means is not desirable, permanent mounting of dispensatory means 125 on bottle 111 can be achieved by joining top 113 to bottle 111 in other ways, such as, by bonding, welding, or lock fit engagement.

Attachment of pressure vessel 135 is achieved by sealing snap-fit retaining engagement of the valve end of said vessel with top 113. For said attachment, there is provided on the under side of top 113 a downwardly projecting neck 115 having an axis of a bore 155 in button 131 of nozzle head 129. Similar to neck 15 described in reference to FIG. 1, neck 115 has a large inside diameter aperture 117 having an annular ledge 119 and an annular latching lip 121. However, in difference to neck 15, ledge 119 is formed in the upper end of aperture 117 and lip 121 is formed in the lower end of said aperture.

For insertion and sealing retention of vessel 135, neck 115 is adapted to yieldingly allow snap-fit insertion of the valve end of said vessel into said neck from the under side of top 113. After said insertion, ledge 119 and lip 121 act to sealingly and retainingly capture the valve end of said vessel, holding it in place. And concurrent with said insertion, button 131 bore 155 is snuggly coupled with a valve stem that protrudes through aperture 117 from said vessel along the axis of said aperture.

With exception of the above described differences the embodiment shown in FIG. 9 is structurally and functionally the same as the embodiment shown in FIG. 1

MODIFICATION

Figure 10:
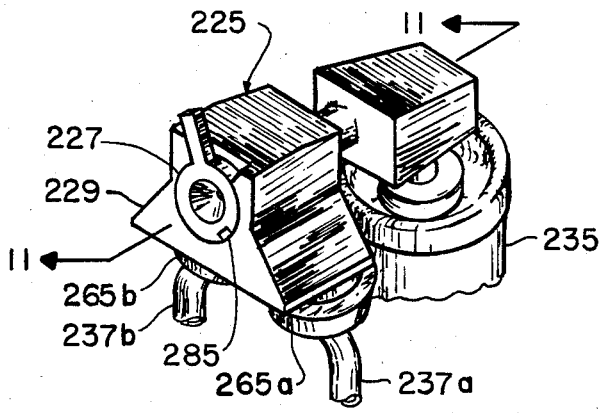
FIG. 10 is a fragmentary isometric view showing an alternative valvular dispensatory means embodiment.

Shown in FIG. 10 is a valvular dispensatory means 225 that is adapted to utilize pressure vapor flow from a single pressure vessel 235 to selectively dispense a first or a second fluent product from a container (not shown) that is adapted to have individual chambers for separately containing first and second fluent products. Said container will be described in a later modification.

Figure 11:
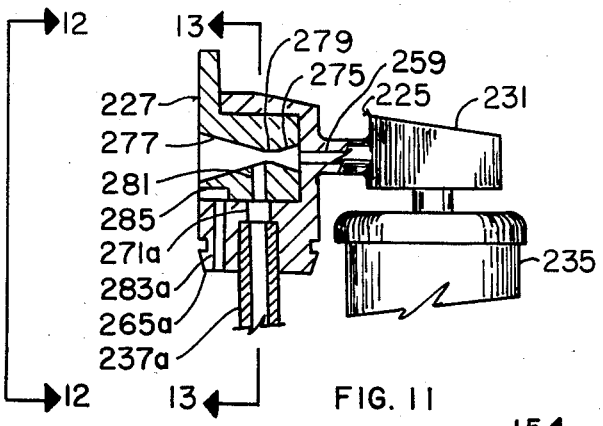
FIG. 11 is a fragmentary cross section view taken through FIG. 10 in the general direction of line 11—11, to further show features of the alternative dispensatory means.
Figure 12:
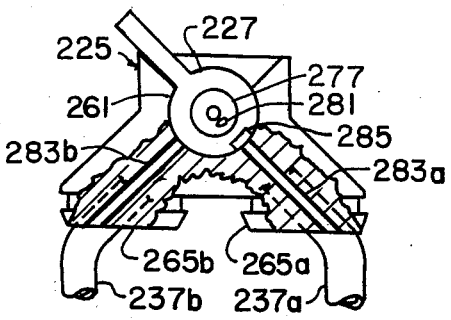
FIG. 12 is a view taken along line 12—12 of FIG. 11, and being broken away to illustrate venting control means provided by the alternative dispensatory means.
Figure 13:
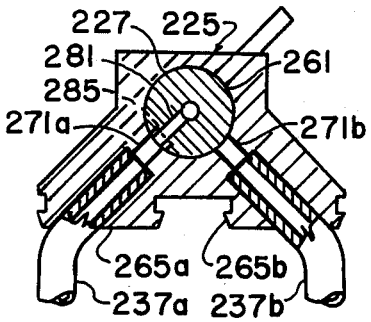
FIG. 13 is a view taken substantially along line 13—13 of FIG. 11, to illustrate product egression control means provided by the alternative dispensatory means.

To accommodate said selective dispensation, as best seen in FIGS. 11, 12 and 13, nozzle head 229 of said dispensatory means is provided with a pair of converging terminuses, terminus 265*a* and terminus 265*b* which respectively contain venting passageways 283*a* and 283*b*, and product passageways 271*a* and 271*b*. Each terminus is adapted, as previously described in reference to FIG. 1, to direct product flow through a single ejector pump type nozzle element 227 that has a single product tap 281 and a single vent notch 285 which are located to be positioned in discriminate flow through alignment with said passageways, respectively, for selective dispensation of product and product chamber venting.

FIG. 11 is taken in the general direction of line 11—11 of FIG. 10 to illustrate alignment of nozzle element 227 tap 281 and notch 285 with terminus 265*a* passageways 271*a* and 283*a* respectively. FIG. 10 further shows that dispensatory means 225 includes button 231 and passageway 259 which are adapted to direct pressure vapor flow through nozzle element 227 to effect product dispensation.

FIGS. 12 and 13 are views respectively taken in the direction of lines 12—12 and 13—13. They illustrate closure of product and venting passageways to one terminus when product and venting passageways in the other terminus are in flow alignment with nozzle element tap 281 and notch 285.

More particularly, FIG. 12 shows that when nozzle element notch 285 is aligned to allow flow of ambient air through passageway 283*a* air flow through passageway 283*b* is sealingly prevented by the outer diamter surface fit of said nozzle element in nozzle head bore 261. Likewise, FIG. 13 shows that when said nozzle element tap is aligned to allow dispensing of product through passageway 271*a*, product flow through passageway 271*b* is sealingly prevented by said fit of said nozzle element in nozzle head bore 261.

It should be understood that said nozzle element can also be positioned to center said notch and said tap between said terminuses and thereby prevent air and product flow through passageways of either terminus.

Figure 14:
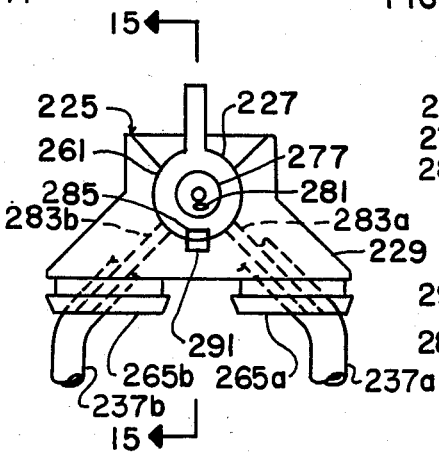
FIG. 14 is a view similar to FIG. 12, to illustrate a self-cleaning feature of the alternative dispensatory means.
Figure 15:
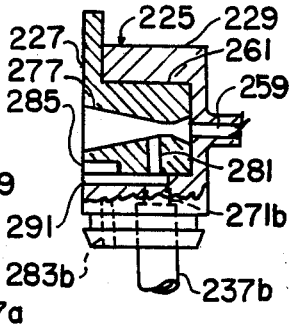
FIG. 15 is a cross section view taken along line 15—15 of FIG. 14, to better show self-cleaning feature provisions.

In FIGS. 14 and 15 dispensatory means 225 is shown to be further modified to include the self-cleaning feature previously described in reference to FIGS. 6–8. Said self-cleaning means is achieved by having a longitudinal notch 291 locationally placed in the mouth of said nozzle head bore 261 for alignment with nozzle element tap 281 when said tap is positionally centered between terminuses 265*a* and 265*b*. Alignment of notch 291 with tap 281 can be seen best in FIG. 15 which is taken in the direction of line 15—15 of FIG. 14. In FIG. 15 notch 291 is shown extending inwardly from the mouth of bore 261 to tap 281 to allow ambient air to be purgingly drawn through said tap by discharge flow of pressure vapor.

All other features and functions of dispensatory means 225 are the same as those previously described in reference to dispensatory means 25.

MODIFICATION

Figure 16:
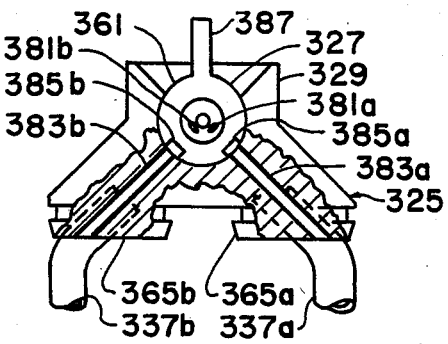
FIG. 16 is a broken away view similar to FIG. 12, showing venting control features of a second alternative dispensatory means.
Figure 17:
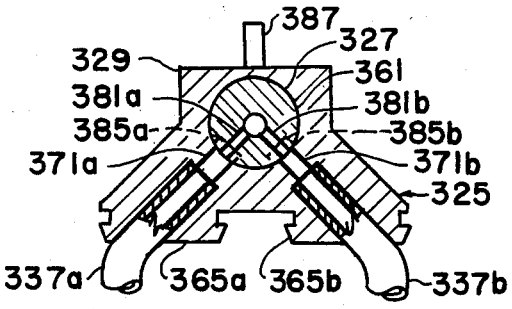
FIG. 17 is a view similar to FIG. 13, showing product egression control means provided by the second alternative dispensatory means.

Shown in FIGS. 16 and 17 is a valvular dispensatory means 325 that is adapted to utilize pressure vapor flow from a single pressure vessel to concurrently dispense a first and a second fluent product from a container having individual chambers for isolated containment of said products. Dispensatory means 325 is essentially the same as dispensatory means 225, the only difference is that the nozzle element 327 contains two ventilating notches, notch 385*a* and notch 385*b*, and two product flow taps, tap 381*a* and tap 381*b*.

With nozzle element 327 centrally positioned as shown in FIGS. 16 and 17 which are respectively comparable to FIGS. 12 and 13, nozzle element 327 is positioned for concurrent dispensation of said first and second products. FIG. 16 particularly shows said nozzle element notches 385*a* and 385*b* aligned respectively with passageways 383*a* and 383*b* of terminuses 365*a* and 365*b* for concurrent venting of product chambers. FIG. 17 shows said nozzle element taps 381*a* and 381*b* aligned respectively with passageways 371*a* and 371*b* of said terminuses for concurrent dispensation of products.

To prevent either venting or product effluence through said passageways of said terminuses, said nozzle element is adapted to be positioned to the left or right of the center position. In either the left or right position, the nozzle element's outer diameter surface fit in nozzle head bore 361 sealingly closes said passageways of said terminuses.

Dispensatory means 325 can be further modified to include the self-cleaning feature previously described. This modification can easily be accomplished by placing a longitudinal notch 391 in nozzle head bore 361 centrally between said terminuses in the same manner as described in reference to notch 291. By having notch 391 centrally located in said bore, self-cleaning can be achieved by positioning said nozzle element to the left or right of center to enable purging flow of ambient air through one nozzle element tap and subsequently positioning said nozzle in the opposite direction to enable purging flow of ambient air through the remaining tap. Notch 391 and notch **391*b* in FIG. 18** are synonymous.

Figure 18:
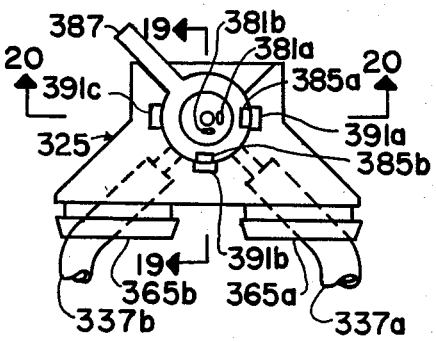
FIG. 18 is another view similar to FIG. 12, to illustrate self-cleaning features of the second alternative dispansatory means.

However it is preferred, as seen in FIG. 18, to provide in nozzle head counter bore 361 three longitudinal notches or grooves, **391*a*, 391*b* and 391*c*, which are located in said bore to provide self-cleaning alignment of nozzle element taps 381*a* and 381*b*** regardless of which position from center said nozzle element is placed.

Figure 19:
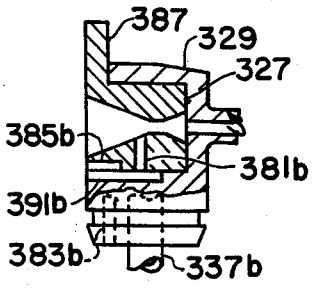
FIG. 19 is a cross sectional view taken in the direction of line 19—19 of FIG. 18, to better show the self-cleaning provisions.
Figure 20:
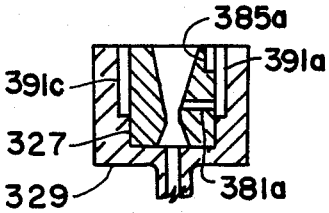
FIG. 20 is a cross sectional view taken in the direction of line 20—20, to further illustrate the self-cleaning provision.

FIGS. 19 and 20 are respectively views taken through FIG. 18 in the direction of lines 19—19 and 20—20 to show alignment of tap **381*a* with notch 391*a* and tap 381*b* with notch 391*b* to enable both taps to be cleaned simultaneously by purging flow of ambient air through both taps. Although notch 391*c* is not shown in alignment with either tap, it should be understood that with nozzle element 327 positioned in the opposite direction from center, tap 381*a* will be aligned with notch 391*b* tap 381*b* will then be aligned with notch 391*c***.

All other functions and features of the valvular dispensatory means 325 are the same or equivalent to those previously described.

MODIFICATION

Figure 21:
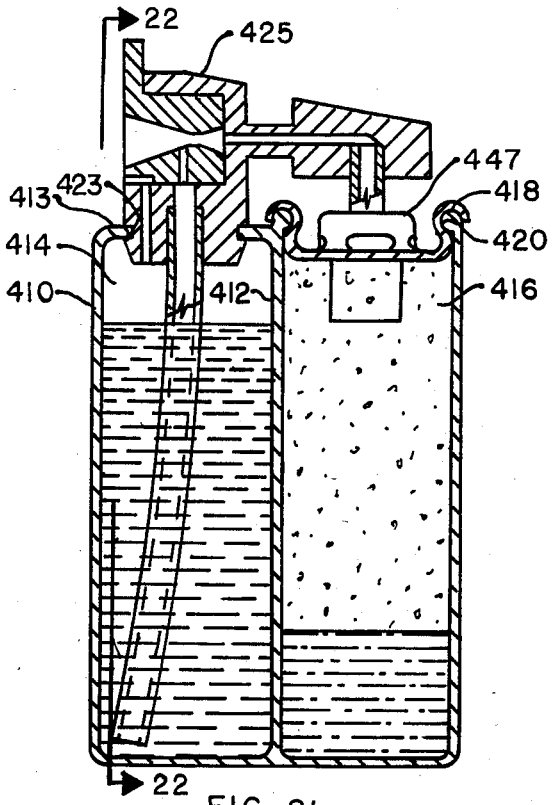
FIG. 21 is a longitudinal side view of another alternative embodiment of the invention, with a portion broken away to better show distinguishing features.

Shown in FIG. 21 is another self-contained fluid pump aerosol dispenser embodiment which is comparable to the embodiment described in reference to FIGS. 1–8. The difference is that the container portion of the pressure vessel is formed as an integral part of the product bottle.

In this embodiment a bottle 410 is provided in place of bottle 11, and internally provided within bottle 410 is a partitioning barrier 412 that separates said bottle into two chambers, a product chamber 414 having an integrally formed closure top 413 that has an aperture 423, and a pressure fluid containment chamber 416. The bottle may be formed from pressure resistant material or pliable plastic type material that is suitably reinforced at the walls defining chamber 416 to selectively provide where nessary a means for withstanding pressure produced by pressure regenerating fluid. The reinforcement can easily be accomplished if needed by embedding fiber glass cloth or metal screening (not shown) in the walls defining chamber 416.

The upper end 418 of chamber 416 is open and provided with an annular bead 420 upon which a valve 447 is conventionally mounted providing a head structure closing chamber 416, and providing a means for discharging pressure fluid vapor. And mounted on said closure top 413 is a valvular dispensatory means 425 that utilizes pressure vapor discharge flow to effect dispensation of product.

Except for those characteristics relating to the pressure vessel and its mounting, all other functions and features described in reference to FIGS. 1–8 are understood to be applicable to the embodiment shown in FIG. 21.

MODIFICATION

Figure 22:
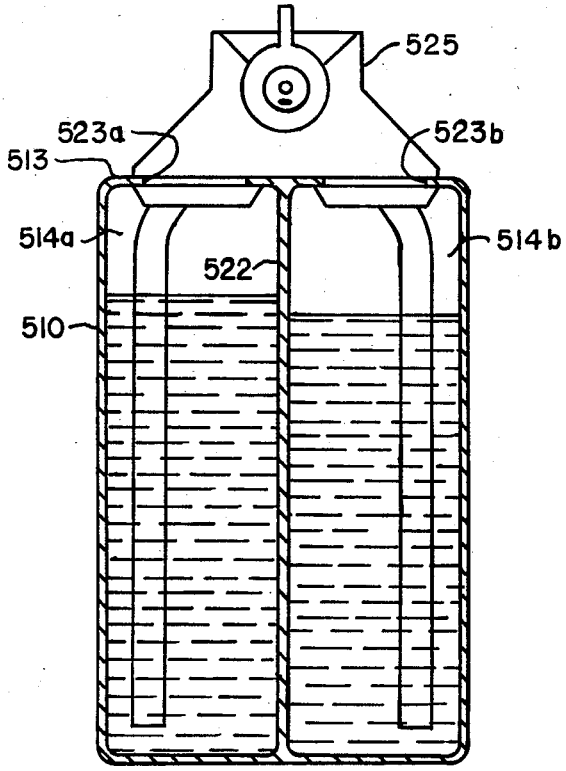
FIG. 22 is a longitudinal view taken in the direction of line 22—22 of FIG. 21, to illustrate still another embodiment of the invention.

In the embodiment shown in FIG. 22 the container or bottle 510 is a further modification of the bottle described in reference to FIG. 21. The product chamber of bottle 510 is additionally subdivided to contain first fluent product and second fluent product in seperate chambers that keep said products apart prior to dispensation. For orientation convenience FIG. 22 is viewed in the direction of line 22—22 of FIG. 21.

Within bottle 510 there is provided a barrier wall 522 that partitions the product chamber portion of said bottle into two product containment chambers designated **514*a* and 514*b*. The upper end of the product portion of said bottle is closed by an integral closure top 513 that has two apertures, aperture 523*a* and aperture 523*b*, which respectively open into said chambers. And mounted on said top is a valvular fluid pump type dispensatory means 525 of the kind described in reference to FIGS. 10–20**.

MODIFICATION

Figure 23:
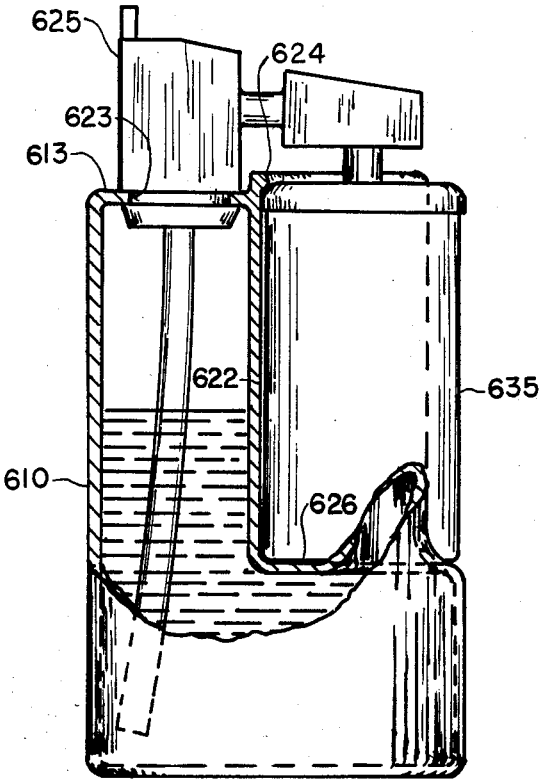
FIG. 23 is a longitudinal side view similar to FIG. 21, to illustrate a still further alternative embodiment of the invention.

Still another embodiment of the invention is shown in FIG. 23. This embodiment is similar to the embodiment shown in FIG. 21, however instead of having a pressure vessel as an integral chamber, this embodiment provides for the pressure vessel to be externally mounted.

As seen in FIG. 23 a pressure vessel 635, as previously described, is integrated with bottle 610 by being retainingly nested in a recessed longitudinal cavity 622 that is depressingly formed along the exterior of said bottle. The length of said cavity extends downwardly from the top of said bottle a sufficient distance to accommodate said vessel, and clampingly hold said vessel in place.

Said cavity having an open upper end that coincides with the upper end of said bottle and formed about said open end there is provided a bead 624 that is adapted to retainingly engage the upper end of said vessel sufficiently to prevent excessive upward movement of said vessel. In addition, said cavity is contoured to mate with and grip the sides of said vessel, and at its lower end said cavity is terminated by a shelf-like surface 626 on which said vessel is shown seated. Cavity 622 is in effect a clip that allows the vessel to be pushed into place and frictionally held.

Bottle 610 is closed at its upper end by an integral closure top 613 that is provided with an aperture 623, and mounted on said top is an appropriate ejector pump valvular dispensatory means 625.

MODIFICATION

Figure 24:
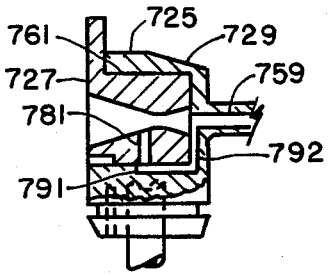
FIG. 24 is a cross section view similar to FIG. 8, showing an additional dispensatory modification which provides for purging use of pressure vapor to effect self-cleaning.

Another valvular dispensatory means modification is shown in FIG. 24 to illustrate a means for diverting pressure vapor discharge flow for use as a purging medium and allowing the dispensatory means to be self cleaning.

As seen in FIG. 24 there is provided in this modification a dispensatory means 725 that includes a nozzle head 729 having product flow and venting passageways, a pressure vapor flow passageway 759 that opens into a counter bore 761, and a nozzle element having a tap 781. Said dispensatory is substantially the same dispensatory means 25 described in reference to FIG. 8. The difference being that instead of a groove 91 at the mouth of bore 61, dispensatory means 725 nozzle head bore 761 is provided with a longitudinal groove or notch 791 that extends from the back of said bore toward the mouth a sufficient distance to provide a flow through by-pass to tap 781. And there is at the back surface of bore 761 an additional groove 792 that converges with notch 791 and joins passageway 759 to enable diversion of pressure vapor flow to said tap. Notch 791 and groove 792 are located in bore 761 so as to be in flow through alignment with tap 781 only whan nozzle element 727 is positioned to sealingly close product flow and venting passageways in nozzle head 729 to prevent either venting or product effluence.

When nozzle element 727 is positioned for product dispensation, the fit of nozzle element 727 in bore 761 sealingly prevents self-cleaning diversion of pressure vapor through tap 781 since in the dispensing position tap 781 is not in communicating alignment with notch 791.

It is thought that the invention and its advantages will be understood from the foregoing description and it apparent that various changes may be made in the form, construction and arrangement of the parts without departing from the spirit and scope of the invention or sacrificing its material advantages, the hereinbefore described forms illustrated in the drawings being merely preferred embodiments.

Having described my invention, reference should now be had to the following claims.

I claim:

1. A self-contained fluid pump aerosol dispenser that maintains separation of fluent product from pressure regenerating fluid, which comprises:

a product fluid container integrated with a pressure vessel that contains pressure regenerating fluid and pressure vapor therefrom;

a pressure vapor discharge control valve disposed on said vessel;

and a dispensatory means mounted on the container and cooperating with said valve, having an ejector type nozzle element that ventilatingly admits ambient air into said container, and utilizes said pressure vapor to effect product effluence;

said dispensatory means having a primary structure defining passageway and within which said nozzle element is sealingly and moveably fitted;

said nozzle element being alternatively positionable within said primary structure of said dispensatory means to inhibit product effluence and ambient air admittance through said dispensatory means.

2. In the invention of claim 1, said primary structure being adapted to provide manual manipulating means for said valve, and including a fluid flow communicating means between said nozzle element and said valve for directing discharge flow of pressure vapor through said nozzle element.

3. A self-contained fluid pump aerosol dispenser that maintains separation of fluent product from pressure regenerating fluid, which comprises:

a product fluid container integrated with a pressure vessel that contains pressure regenerating fluid and pressure vapor therefrom;

a pressure vapor discharge control valve disposed on said vessel;

and a dispensatory means mounted on the container having an ejector type nozzle element that is adapted to ventilatingly admit ambient air into said container, and utilize said pressure vapor to effect product effluence;

said dispensatory means having a primary structure defining passageway and within which said nozzle element is sealingly and moveably fitted;

said nozzle element being alternatively positionable within said primary structure to allow product effluence and ambient air admittance through said dispensatory means;

said primary structure being adapted to provide manual manipulating means for said valve, and including a fluid flow communicating means between said nozzle element and said valve for directing discharge flow of pressure vapor through said nozzle element;

said nozzle element being rotatably positionable to inhibit product effluence and inhibit ambient air passage through said dispensatory means.

4. In the invention of claim 3, said dispensatory means being adapted to be self-cleaning.

5. In the invention of claim 4, ambient air being a purging medium for said self-cleaning.

6. In the invention of claim 5, said primary structure having at least one ambient air inlet that enables discharge flow of pressure vapor to effect purging circulation of ambient air through said nozzle element when said nozzle element is positioned to inhibit product effluence and ambient air passage through said dispensatory means

7. In the invention of claim 4, said pressure vapor being a purging medium for said self-cleaning.

8. In the invention of claim 7, said primary structure having at least one by-pass means that enables purging diversion of said pressure vapor through said nozzle element to effect said self-cleaning when said nozzle element is positioned to inhibit product effluence and ambient air passage through said dispensatroy means.

9. A self-contained fluid pump aerosol dispenser that segregatingly holds dispensible fluent product and pressure regenerating fluid, which comprises:

a container for sealed containment of fluent product, having a top closure structure;

a pressure vessel that is integrated with said container, containing a pressure regenerating fluid and pressure vapor therefrom, and having a valve means for controlled discharge of said pressure vapor;

and a dispensatory means having a stationary primary structure sealingly mounted on said top closure structure;

said dispensatory means also having an ejector type discharge nozzle element that is sealingly and moveably fitted in said primary structure;

said primary structure having a flexibly attached appendage that is co-operatively engaged with said vessel valve means and adapted to provide a means for manual manipulation of said valve means;

said appendage having a vapor flow passage means that is adapted to direct discharge flow of said pressure vapor through said nozzle element;

said nozzle element having an ambient air inlet means for ventilation of said container, and a tap means that is adapted to cooperate with pressure vapor discharge flow to effect product dispensation;

said primary structure also having a ventilation passageway means and a product flow passageway means in communication with the interior of said container and said nozzle element;

said nozzle element being manually positionable within said primary structure to facilitate both alignment of said ventilation passageway with said nozzle element inlet means, and said product flow passageway with said tap means to allow inflow of ambient air into and the egression of product from the interior of said container respectively, said nozzle element being alternatively positionable to inhibit the inflow of ambient air into and the egression of product from the interior of said container.

10. In the invention of claim 9, said container, containing a dispensible fluent product.

11. In the invention of claim 9, said top closure structure having an aperture for mounting said pressure vessel;

said pressure vessel being sealingly depending from said aperture, and being substantially contained within said container;

said valve means protruding outwardly through said aperture.

12. In the invention of claim 9, said vessel being retainingly nested in an exterior recess of said container.

13. In the invention of claim 9 said pressure vessel being an integrally formed part of said container.

14. In the invention of claim 9, said container having an open upper end;

and said top structure being sealing and detachably affixed on said open end.

15. In the invention of claim 14, said dispensatory means primary structure being an integrally formed part of said top structure.

16. A self-contained fluid pump aerosol dispenser that seregatingly holds dispensible fluent Product and pressure regenerating fluid, which comprises:

a container having individual first and second chambers respectively containing first fluent product and second fluent product;

a top closure structure sealingly affixed on said container and closing said chambers;

a pressure vessel that is integrated with said container containing a pressure regenerating fluid and pressure vapor therefrom; and having a valve means sealing closing said vessel and providing a means for controlled discharged of said pressure vapor;

and a dispensatory means having a stationary primary structure sealingly mounted on said top structure;

said dispensatory means also having an ejector type nozzle element that is sealingly and moveably fitted in said primary structure;

said primary structure having a flexibly attached appendage that is co-operatively engaged with said vessel valve means and adapted to provide a means for manual manipulation of said valve means;

said appendage having a vapor flow passage means that is adapted to direct discharge flow of said pressure vapor through said nozzle element;

said nozzle element having an ambient air inlet means for ventilation of said container, and a tap means that is adapted to cooperate with pressure vapor discharge flow to effect product dispensation;

said primary structure also having a first ventilation passageway means and a first fluent product passageway means in communication with said first chamber and said nozzle element;

said primary structure further having a second ventilation passageway means and a second fluent product passageway means in communication with said second chamber and said nozzle element;

said nozzle element being manually positionable to a first position within said primary structure to inhibit inflow of ambient air into and the egression of product from said second chamber, and to facilitate both alignment of said first ventilation passageway with said nozzle element inlet means, and said first product flow passageway with said tap means to allow inflow of ambient air into and the egression of product from said first chamber respectively;

said nozzle element also being manually positionable to a second position within said primary structure to inhibit inflow of ambient air into and the egression of product from said first chamber, and to facilitate both alignment of said second ventilation passageway with said nozzle element inlet means, and said second product flow passageway with said tap means to allow inflow of ambient air into and the egression of product from said second chamber respectively;

said nozzle element further being manually positionable to a third position within said primary structure to inhibit the inflow of ambient air into and the egression of product from said first and second chambers concurrently.

17. In the invention of claim 16, said dispensatory means being adapted to be self-cleaning.

18. A self-contained fluid pump aerosol dispenser that segregatingly holds dispensible fluent product and pressure regenerating fluid, which comprises:

a container having individual first and second chambers respectively containing first fluent product and second fluent product;

a top closure structure sealingly affixed on said container and closing said chambers;

a pressure vessel that is integrated with said container containing a pressure regenerating fluid and pressure vapor therefrom, and having a valve means sealingly closing said vessel and providing a means for controlled discharge of said pressure vapor;

and a dispensatory means having a stationary primary structure sealingly mounted on said top structure;

said dispensatory means also having an ejector type nozzle element that is sealingly and moveably fitted in said primary structure;

said primary structure having a flexible attached appendage that is co-operatively engaged with said vessel valve means and adapted to provide a means for manual manipulation of said valve means;

said appendage having a vapor flow passage means that is adapted to direct discharge flow of said pressure vapor through said nozzle element;

said nozzle element having an ambient air first inlet means for ventilation of said first product chamber, and a first tap means that is adapted to cooperate with pressure vapor discharge flow to effect first product dispensation;

said nozzle element also having an ambient air second inlet means for ventilation of said second product chamber, and a second tap means that is adapted to cooperate with pressure vapor discharge flow to effect second product dispensation;

said primary structure correspondingly having a first ventilation passageway means and a first fluent product passageway means in communication with said first chamber and said nozzle element, and a second ventilation passageway means and a second fluent product passageway means in communication with said second chamber and said nozzle element;

said nozzle element being manually positionable to a first position within said primary structure to facilitate both alignment of said first and second ventilation passageways with said nozzle element first and second inlet means respectively, and said first and second product passageways with said first and second tap means respectively, to allow inflow of ambient air into and the egression product from said first and second chambers respectively for concurrent dispensation of said first and second fluent product;

said nozzle element being also positionable to a second position within said primary structure to concurrently inhibit the inflow of ambient air into and the egression of product from said first and second chambers.

19. In the invention of claim 18, said dispensatory means being adapted to be self-cleaning.

* * * * *